United States Patent [19]

Jessop

[11] Patent Number: 4,804,990

[45] Date of Patent: Feb. 14, 1989

[54] AUTOMATIC LIQUID FEED AND CIRCULATION SYSTEM FOR A PHOTOGRAPHIC FILM PROCESSOR

[75] Inventor: Thomas C. Jessop, Webster, N.Y.

[73] Assignee: Eastman Kodak Company, Rochester, N.Y.

[21] Appl. No.: 154,118

[22] Filed: Feb. 8, 1988

[51] Int. Cl.[4] ..... G03D 3/02

[52] U.S. Cl. ..... 354/324; 137/565

[58] Field of Search ..... 354/320, 321, 322, 324, 354/331; 137/563, 567

[56] References Cited

U.S. PATENT DOCUMENTS

| | | | |
|---|---|---|---|
| 3,851,662 | 12/1974 | Jessop | 354/324 |
| 3,922,702 | 11/1975 | Gaskell | 354/321 |
| 4,268,156 | 5/1981 | Kostiner | 354/324 |
| 4,312,585 | 1/1982 | Otsu et al. | 354/321 |
| 4,312,586 | 1/1982 | Ohtani | 354/324 |
| 4,641,941 | 2/1987 | Yoshimi | 354/324 |

*Primary Examiner*—A. A. Mathews

*Attorney, Agent, or Firm*—Robert H. Sproule

[57] ABSTRACT

A replenishment and recirculation system for photographic processing fluids includes a number of tanks of which at least one is divided into first and second sections by a wall having a top edge which is submerged below the surface of the fluid. Processing fluid is pumped out of the first section of the tank, filtered, and then pumped back into the second section of the tank in a manner to cause the fluid to circulate inside the second section between the bottom of the tank and the top surface of the fluid. The top portion of the circulating fluid flows across the top of the submerged wall and into the first section of the tank to be pumped back into the second container section. Fresh processing fluid is added into the first section of the tank where it mixes with the fluid present therein, before being withdrawn and pumped into the second section of the tank which contains the photographic paper.

10 Claims, 6 Drawing Sheets

FIG. 4
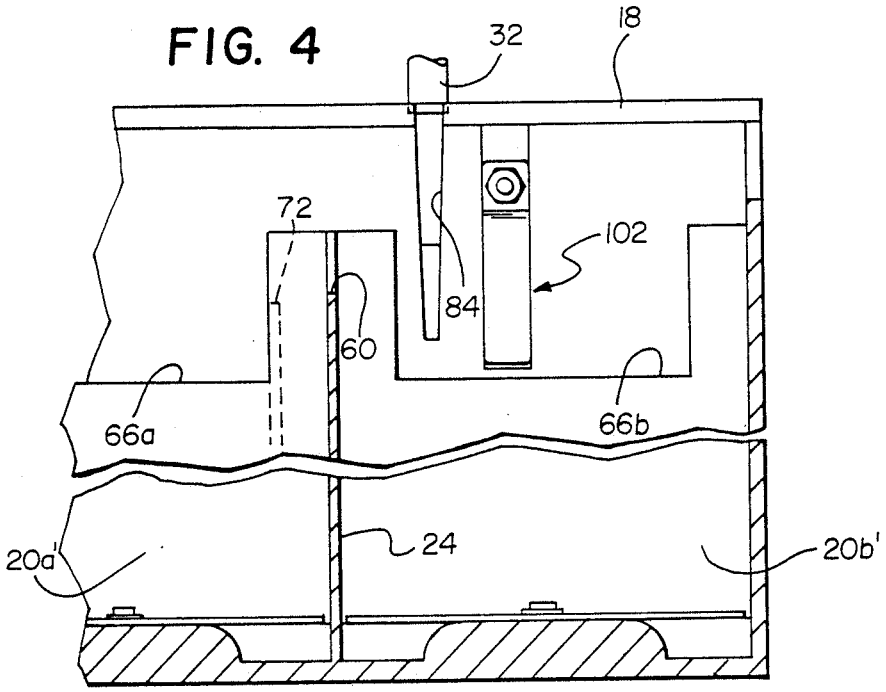
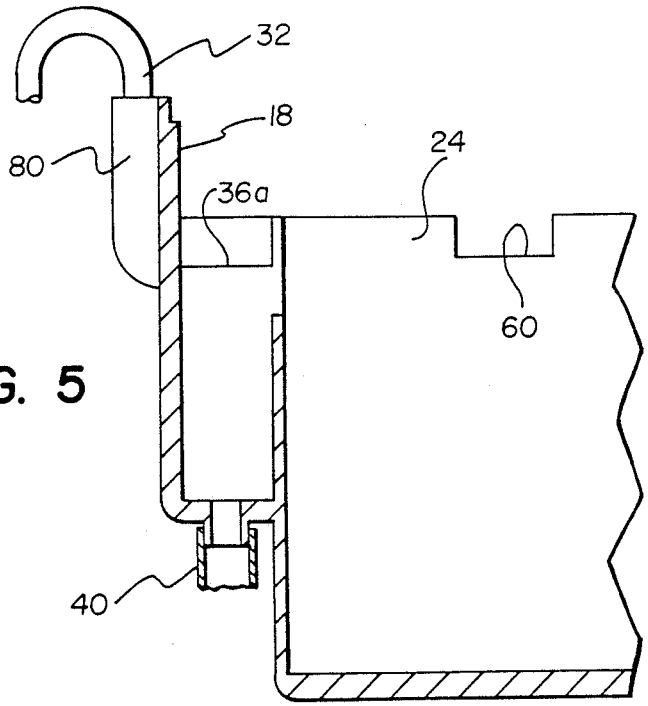
FIG. 5

AUTOMATIC LIQUID FEED AND CIRCULATION SYSTEM FOR A PHOTOGRAPHIC FILM PROCESSOR

TECHNICAL FIELD

The present invention pertains to a system for automatically developing a latent image onto photographic paper, and more particularly to a system for replenishing and circulating chemical processing solution in order to develop a latent image on the photographic paper.

BACKGROUND OF THE INVENTION

For the automatic development of a photographic image onto paper, there is available what is commonly known as a "developing minilab" which consists of a small, self-contained work station which has the capability of forming a latent image of desired size and orientation from a negative onto photographic paper. The minilab then chemically develops this latent image in permanent form onto the paper. The development of the latent image is typically accomplished in a number of individual chemical tanks located inside the minilab which contain developer, bleach-fix, and stabilizer. At the conclusion of the chemical processing, the photographic paper is automatically dried and then discharged from the machine for delivery to the customer.

In the chemical processing of the latent image, a number of process variables must be controlled within relatively small tolerances. For instance, the processing chemicals must be replenished and maintained as they are used up in the development of the latent image. As the fresh chemicals are added, it is important that they be evenly distributed throughout the solution so as to maintain a uniform concentration. Otherwise, concentration gradients can appear in the solution which cause the paper to become streaked during the developing process. It also is desirable that the contaminants formed during the developing process be removed. It is further desirable to control the level of processing chemicals in the bath in order to insure the photographic paper which is being transported through the bath is properly treated. It is also a desired feature to minimize the amount of oxygen introduced into the processing chemicals in order to prevent their oxidation. This requires that any turbulence of the chemicals during processing be minimized so as to minimize their aeration.

Conventionally, a number of photographic film processors have been disclosed. For example, in U.S. Pat. No. 4,268,156 by Kostiner there is described a washing apparatus for photographic materials wherein there is provided a tank having a lower system for introducing processing chemicals and an upper weir which forms a zone for removing the chemicals from the tank.

A liquid circulating system for photographic film processing is discussed by Gaskell in U.S. Pat. No. 3,922,702, wherein liquid circulation is achieved by removing the liquid from the upper part of the tank and then pumping it back in through an inlet distribution chamber in the bottom of the tank.

Otsu, in U.S. Pat. No. 4,312,585, discusses a system for treating photographic film in which a recirculating flow of treatment liquid is established over the film.

Furthermore, a treatment tank for photographic film is disclosed in U.S. Pat. No. 4,641,941 by Yoshimi, wherein the tank has a number of overflow devices for removing insoluble solids suspended in the treatment liquid.

SUMMARY OF THE INVENTION

The present invention pertains to a fluid replenishment and recirculation system which includes means, such as a tank, for containing the fluid. The containing means includes a first container section and a second container section which are separated by a flow diverting wall which has a top edge which is located below the top surface of the fluid. The system also includes means, such as a pump, for transferring the fluid from the first container section to the second container section. In addition, the system includes means for inputting the transferred fluid from the transferring means into the second container section in a manner that the fluid in the second container section is moved in a circulating pattern so that an upper portion of the circulating fluid is distributed across the top edge of the flow diverting wall and back into the first container section. In this manner, a circulating flow of the fluid is achieved to obtain improved mixing of the fluid.

BRIEF DESCRIPTION OF THE DRAWINGS

Other objects and advantages of the present invention will become more readily apparent upon reading the following detailed description in conjunction with the attached drawings, in which:

FIG. 4 is a partial section of the chemical processing portion taken along line 4—4 of FIG. 1;

FIG. 5 is a partial section taken along line 5—5 of FIG. 1; and

DETAILED DESCRIPTION OF THE INVENTION

The present invention pertains to a system for introducing and circulating liquids in a container. However, in an exemplary embodiment, the present invention more narrowly pertains to a system for introducing, circulating, and recirculating photographic processing chemicals in a container in order to automatically develop a latent image onto photographic paper which is fed through the container.

Figure 1:
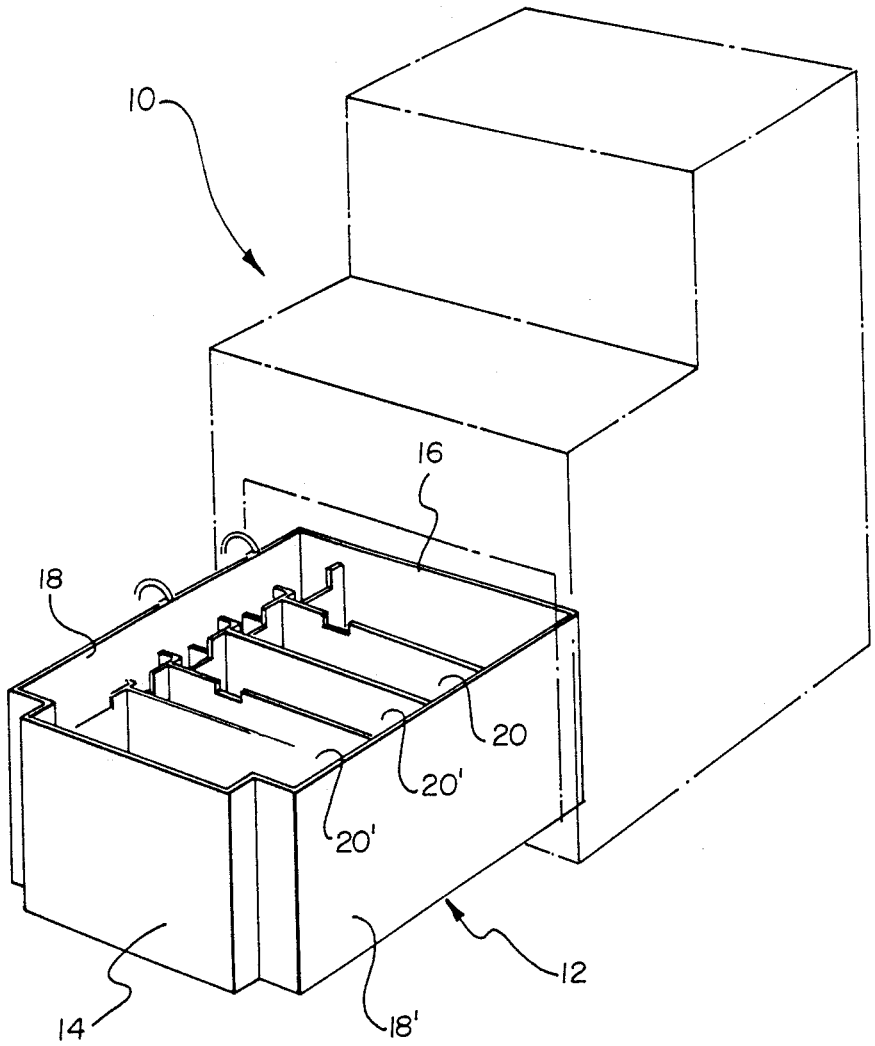
FIG. 1 is an isometric view of an exemplary embodiment wherein there is shown a photograph development station including a lower chemical processing portion.

Referring first to FIG. 1, there is shown a photographic developing workstation generally indicated at 10 which forms a latent image onto photographic paper in a conventional manner. After formation of the latent image, the photographic paper is fed down into a chemical processing container indicated at 12 which is shown in an inoperative position being partially removed from the workstation 10. The processor container 12, formed by front and rear walls 14, 16, as well as by left and right side walls 18, 18', is divided internally into a number of individual tanks 20 which contain developer, bleach-fix, and stabilizer solutions. In this embodiment, the stabilizer solution occupies two tanks 20' for reasons that will become apparent shortly.

Figure 2:
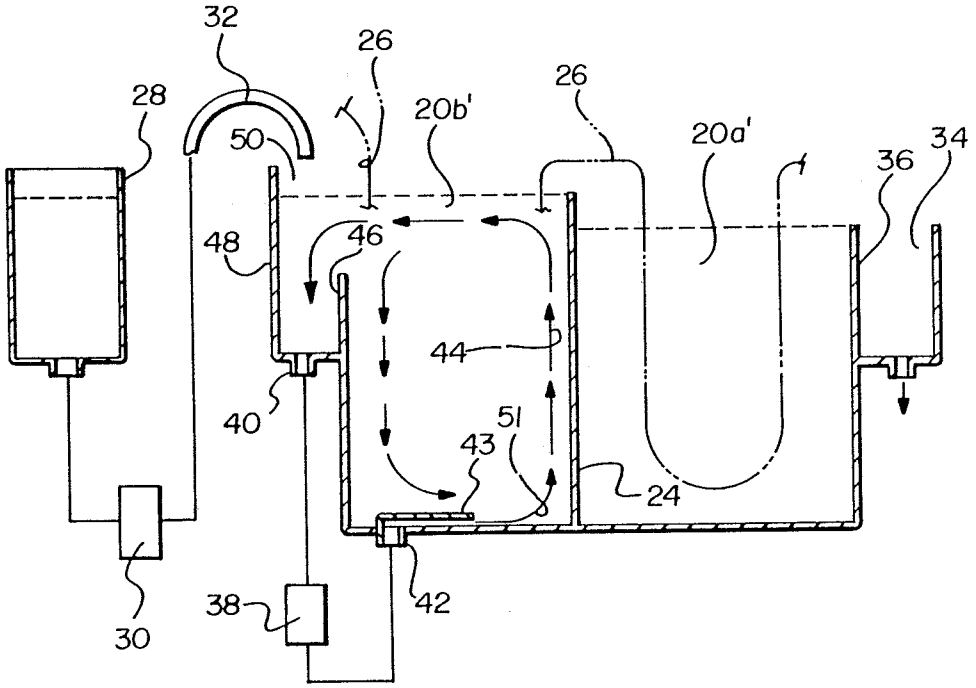
FIG. 2 is a simplified sectional view of an exemplary chemical processing portion of the station.
Figure 3:
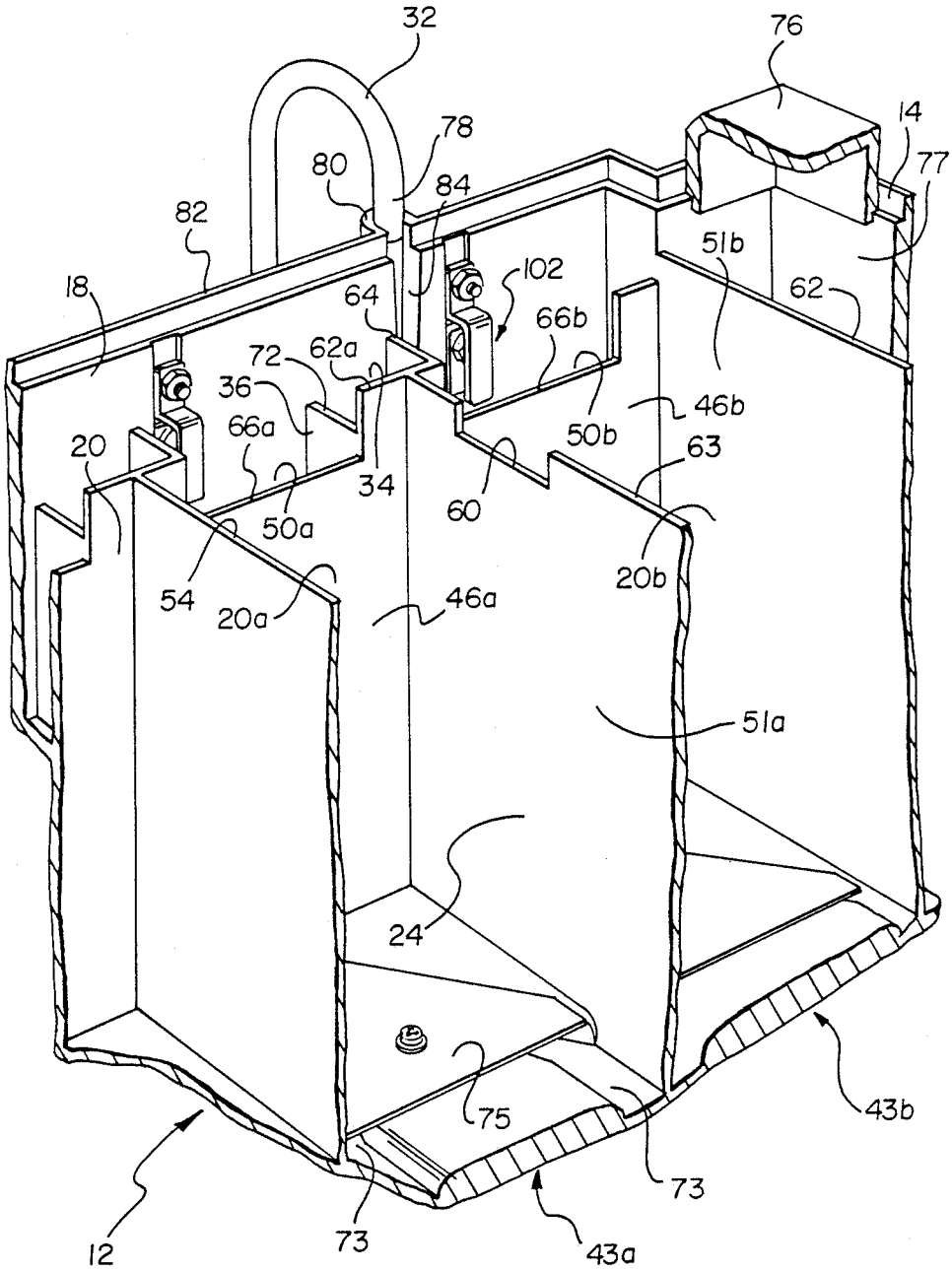
FIG. 3 is an isometric cutaway view of the chemical processing portion.

Before returning to the specific embodiment of the processor tanks shown in detail in FIGS. 3 through 5, reference is made to a simplified system shown in FIG. 2. The system includes a first processor tank 20a' and a second processor tank 20b' which are separated by a common divider wall 24. Photographic paper, identified by the number 26, is introduced down into the right side of tank 20a', where it makes a U-turn near the bottom of the tank and then proceeds upward at the left side of the tank. Upon emerging from tank 20a', the paper is caused to reverse direction and is fed downward into the right side of tank 20b', where it makes a U-turn at the bottom of the tank, and is fed upward and out of tank 20b'. The photographic paper is fed through tanks 20a' and 20b' by roller assemblies, such as those described in a copending application assigned to the assignee of the present invention, filed Jan. 7, 1988 by T. C. Jessop et al and entitled "Dryer Assembly for Photographic Paper."

Replenishment of fresh processing solution into tank 20b' (FIG. 2) is accomplished from a replenisher tank 28 via a pump 30 and J-tube 32. As the level of fluid in tank 20b' exceeds the height of a cutout portion (not shown in FIG. 2) located in the top edge of the separating wall 24, the fluid from tank 20b' overflows into tank 20a' and raises its fluid level. Removal of used fluid from the system is accomplished by means of a drain tank 34 which adjoins and is separated from the tank 20a' by a common wall 36. When the level of fluid in tank 20a' exceeds the height of a cutout (not shown in FIG. 2) in the top edge of common wall 36, the fluid overflows into the drain tank 34 from where it is drained and carried off.

As discussed briefly in the Background of the Invention, it is important that the concentrations of the solution remain uniform throughout each of the tanks 20a' and 20b'. Typically, the concentration of processing solution will be higher in tank 20b' since this tank is replenished with fresh processing solution. However it is important that this higher concentration of processing solution be uniformly distributed in tank 20b', just as the lower concentration of processing solution be unformly distributed in tank 20a'. This is accomplished in the present invention by providing a recirculating pump 38 (FIG. 2) which has its inlet tied to a drain 40 at the left side of tank 20b', and its outlet tied to an opening 42 in the bottom middle of tank 20b'. Connected to the opening 42 is a fluid distributor 43 which channels the incoming fluid along the floor and to the right side of the tank 20b'. In this manner, a counterclockwise circulating flow (when viewing FIG. 2) of fluids is achieved inside tank 20'. This flow, indicated by the arrows identified by the number 44, provides a mixing action inside the tank to uniformly disperse the processing solution. In order to remove insoluble contaminants from the processing solution, the fluid is filtered prior to being returned to tank 20b' via the inlet 42.

In order to achieve this circulating flow of fluid inside tank 20b', there is provided a flow diverting wall 46 which is located parallel to and between the divider wall 24 and an exterior wall 48 of the tank 20b'. The exterior wall 48 and flow diverting wall 46 define a flow diverting section 50 of the tank 20b', while a flow circulating section 51 is defined by the flow diverting wall 46 and the divider wall 24. The top of the flow diverting wall 46 is located below the level of processing fluid in tank 20b' so that approximately the top quarter of fluid in the tank is caused by the circulating action in the tank to cross over the top of flow diverting wall 46 and to be withdrawn out of the flow diverting section 50 by the pump 38. The processing fluid is then filtered and returned to the flow circulating section 51 of the tank 20b' via inlet 42. Meanwhile the lower portion of the fluid is directed by the flow diverting wall 46 back downward toward the bottom of the tank to be circulated (as indicated by the arrows 44) inside the flow circulating section 51 of the tank 20b'. It should be appreciated that by utilizing a submerged flow diverting wall 46 to remove a portion of the circulating fluid, there is little or no turbulence created at the top surface of the fluid and therefore unwanted aeration of the fluid is minimized.

As photographic paper is introduced into the tank for processing, pump 30 is energized to add fresh fluid into tank 20b' via the J-tube 32. As shown by FIG. 2, the J-tube 32 discharges the fresh fluid into the flow diverting section 50 of tank 20b'. In this manner fresh fluid is not introduced directly into the circulating section 51 of the tank which contains the photographic paper. Rather, the fresh fluid is first diluted in the flow diverting section 50, then recirculated by the pump 38, warmed to the proper temperature by a heater (not shown), and then introduced into the bottom of the circulating section 51 for further mixing and dilution as a consequence of the aforementioned "circulating action". Removal of used processor fluid from the system is accomplished by the overflow of processor fluid from tank 20a' into the drain tank 34. This overflow of fluid into the drain tank is in response to fresh fluid being introduced into the left tank 20b'.

In an alternate embodiment to the system shown in FIG. 2, attention now will be turned to FIG. 3. where like elements shown in FIGS. 1 and 2 are identified by like numerals. In this embodiment, processing tank 20a' is formed by the left and right sidewalls 18 (the right sidewall 18' is not shown in FIG. 3), as well as by a divider wall 54 which extends laterally between the left and right sidewalls 18 and which separates the tanks 20a' from the adjoining tank 20. In order to separate the stabilizer tanks 20a' and 20b', the wall 24 extends laterally between sidewalls 18. In a further exemplary embodiment, the processing tanks 20a', 20b' contain stabilizer, while the tank which adjoins tank 20a' via wall 54 contains bleach-fix.

In addition, tank 20b' is formed by the left, right side walls 18, the divider wall 24, and a divider wall 62 which extends between the left, right sidewalls 18. In an exemplary embodiment, the tank which adjoins tank 20b' via the wall 62 is used for drying the paper after treatment by the processing chemicals. The aforementioned overflow of processing fluid from tank 20b' into tank 20a' is accomplished by a U-shaped cutout 60 which extends below a top edge 63 of the divider wall 24. The travel of photographic paper is in a left to right direction in FIG. 3; that is, the paper first travels through tank 20a', and then downstream through tank 20b'.

In the present embodiment, the aforementioned circulating flow of fluid (identified by arrows 44 in FIG. 2) is accomplished in each of the tanks 20a', 20b'. More specifically, tank 20a' includes a flow diverting wall 46a which extends between divider walls 24, 54 in a manner parallel to left sidewall 18 to form a portion of a flow diverting section 50a. Similarly, tank 20b' includes a flow diverting wall 46b which extends between walls 24, 62 in a direction parallel to left end wall 18. In order to form the discharge tank 34, there is provided a wall 36 which extends between flow diverting wall 46*a* and the left sidewall 18 in a direction parallel to the divider wall 24. The remainder of drain tank 34 is formed by i) a second wall 64 which extends between flow diverting wall 46*b* and left end wall 18 in a direction parallel to the first wall 36, as well as by ii) portions of sidewall 18 and the flow diverting walls 46*a*, 46*b*. The drain wall 64 together with sidewall 18, divider wall 62, and flow diverting wall 46*b* also forms a flow diverting section 50*b* in tank 20*b*'. Flow of fluid into the flow diverting section of tank 20*a*' is permitted by a U-shaped cutout 66*a* of flow diverting wall 46*a*. The cutout 66*a* extends below the upper edge 68*a* of the flow diverting wall 46*a* so that it is below the level of cutout 60 of the divider wall 24. Similarly, to accomplish flow diversion in the tank 20*b*', flow diversion wall 46*b* includes a U-shaped cutout 66*b* which is level with cutout 66*a* of tank 20*a*' and below cutout 60 of divider wall 24.

The replenishment of fresh processing fluid into tanks 20*a*', 20*b*' is accomplished by means of the J-tube 32 which discharges into the flow diversion section 50*b* of the tank 20*b*'. In operation, as fluid is replenished into the flow diversion section 50*b*, it mixes with the fluid therein and is returned to the circulating section 51*b* of the tank by means of a pump and filter (not shown). In addition, fluid from flow diversion section 50*a* is withdrawn by another pump and filter (not shown) and returned via an inlet in the bottom of the flow circulating section 51*a*. A portion of the fluid inside tank 20*b*' is circulated across cutout 66*b* and into the flow diversion section 50*b* to be withdrawn and filtered before returning through the bottom of the circulating section 51*b*. When fresh fluid is added, the mixed fluid in tank 20*b*' overflows across cutout 60 into tank 20*a*'. This in turn raises the level of the fluid in tank 20*a*' causing it to overflow from the flow diversion section 50*a* into drain tank 34. It should be appreciated that by placing the the top of the drain wall 36 below the level of cutout 60 as best seen in FIG. 4, the level of fluid in tank 20*a*' is held below the level of fluid in tank 20*b*' thereby preventing the fluid in tank 20*a*' from backflowing into tank 20*b*'.

Since the photographic paper is first introduced into the left tank 20*a*' (FIG. 3), the concentration of contaminants in this tank is typically greater than the concentration of contaminants in the right tank 20*b*'. Furthermore, the concentration of contaminants is particularly great near the top surface of the processor fluid. This is because as the paper is carried into the stabilizer tank 20*a*' from the adjacent tank, containing bleach-fix for example, as the paper enters the stabilizer solution any bleach-fix remaining on the paper is skimmed off at the surface of the stabilizer. Without the aforementioned circulating flow in tank 20*a*', the bleach-fix contaminant will remain at or near the surface of the stabilizer solution to be again deposited onto the surface of the paper as it departs from tank 20*a*' on its way to tank 20*b*'. The circulating flow in tank 20*a*' distributes the contaminant throughout the tank so that the concentration of contaminant remaining at the surface is greatly reduced. For this reason, together with the fact that fresh processing solution is introduced into tank 20*a*', the processor solution inside tank 20*a*' is kept cleaner than that in tank 20*b*'. This minimizes the amount of bleach-fix present on the paper during a drying process which occurs downstream of the stabilizer tanks.

The aforementioned circulating flow of the processor fluid inside the tanks 20*a*', 20*b*' is further promoted by respective fluid distributors 43*a*, 43*b* (FIG. 3) which are located at the bottom of the tanks in the circulating sections 51*a*, 51*b*. Each flow distributor is formed by (1) a pair of channels 73 (FIG. 3) which are oriented in a V-shaped configuration along the floor of the container, as well as by (2) a top plate 75 which covers a majority of the length of the channels 73. In this manner, incoming fluid from the inlet 42 is caused to split and flow outward along the divider walls 54, 24, and 62 of the tanks. When this fluid reaches the far sidewall 18' (not shown in FIG. 3), it is directed in an upward direction until reaching the fluid surface where it is directed in a reverse direction toward the opposite sidewall 18. That portion of the fluid which engages the flow diverting wall 46 is directed downward toward the floor of the tank, while the remainder of the fluid enters the flow diverting section as discussed previously.

In order to prevent external light from reaching the photographic paper, the processor container includes a removable cover 76, a portion of which is shown in FIG. 3. To maintain a light-tight seal between the cover 76 and lower body 77 of the container, an outlet end 78 of the J-tube 32 is secured into the upper end of an upstanding tubular housing 80 which is integral with the outer surface of exterior wall 18. In this embodiment, the upper end of the housing 80 is level with the top edge of the container body. While the upper end of the housing 80 is open in order to receive the J-tube 32, the lower end is closed as shown more clearly in FIG. 5. Entrance of the fluid from the housing 80 into the container is achieved by a vertical opening 84 (FIG. 3) in the wall 18. The opening 84 extends from the upper edge of the container body, downward along the length of the tubular housing 80. In this manner when the cover 76 is in place, a light-tight seal is formed between the cover and the container body, yet the entry of fresh processing fluid is permitted. This light-tight seal is enhanced by the processor fluid which is maintained at a sufficient level inside the container to cover a majority of the length of the opening 84.

Figure 6:
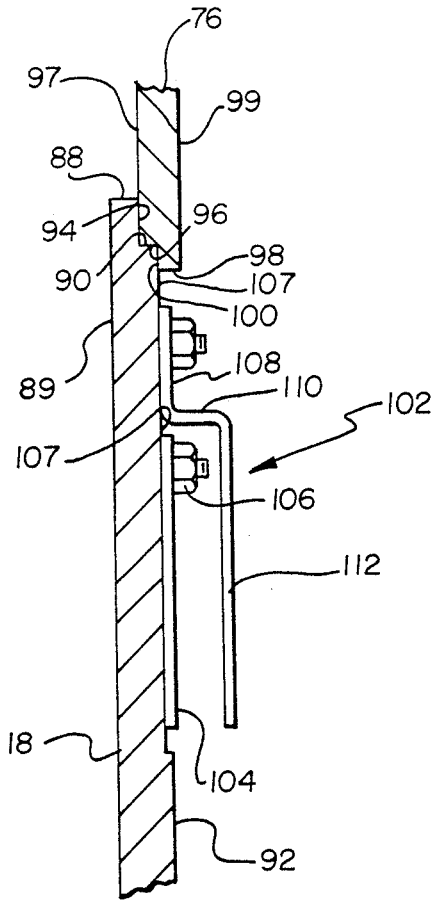
FIG. 6 is a partial section of the container body and adjoining cover.

A significant problem in dealing with photographic processing chemicals is the leakage of these chemicals between the cover and the container body. More specifically, any processing chemical which is spilled onto the lower edge of the cover or onto the upper edge of the container body and which runs down the inside wall of the container body can produce a "wicking" action. This wicking action can draw additional processing chemical up to these edges and down the exterior surface of the container body and onto the floor. In order to eliminate this problem, the upper edge of the container body has an L-shaped cross sectional configuration as shown in FIG. 6, including an upper horizontal ledge 88 which joins with the vertical exterior surface 89 of the end wall 18, and a lower horizontal support ledge 90 which joins with the vertical interior surface 92 of the end wall 18. The upper ledge 88 and lower ledge 90 are joined by an intermediate vertical surface 94. Similarly, the lower edge of the cover has an inverted L-shaped cross sectional configuration formed by an upper horizontal abutting surface 96 which is joined to an exterior vertical surface 97 of the cover wall, and a lower horizontal surface 98 which is joined to an interior vertical surface 99 of the cover wall. Joining the upper surface 96 and lower surface 98 is an intermediate vertical surface 100. In this manner, a light-tight seal between the cover and container body is created when the cover surface 96 is supported on the container body ledge 90. This seal is formed by opposing abutting surfaces 94, 97, as well as opposing abutting surfaces 90, 96, and 92, 100. In addition, any processing chemical which may wick through the interface between the cover and the container body is suspended on the open ledge 88 of the container body where it remains until evaporated, instead of running down the exterior surface 89 and onto the floor.

As mentioned previously, it is desirable to maintain a certain minimum level of processor fluid in the container body. This is accomplished by a level sensing system including a power source (not shown) which is connected to an electrical sensor indicated at 102 in FIG. 6. In this embodiment, the sensor 102 sends a signal to an operator to initiate corrective action. In the present invention the sensor 102 is formed by two electrical contacts (to be described later) which are positioned on the interior surface of the container wall so that their bottom edges are at the desired processor fluid level. When the processor fluid reaches the desired level, the ends of the electrical contacts are submerged. This completes an electrical circuit between the contacts. However, when the level of processor fluid falls below the level of the electrical contacts, the electrical circuit between the contacts is interrupted, and the warning signal is generated. A problem results when both electrical contacts are mounted flush against the interior surface of the container wall. That is, as the level of the processing fluid drops, an electrically conductive residue remains on the wall surface to maintain continuity of the electrical circuit and thereby give a false indication of the fluid level. To overcome this problem, in the present invention there is provided the sensor 102 (FIG. 6) which includes a lower elongate electrical contact element 104 which is attached by a fastener 106 in a vertical position to the interior surface 92 of the container body in a manner that the rear surface of the contact element 104 is flush against the container interior surface. The level sensor is further formed by an upper contact element which includes an upper vertical portion 108 which is mounted by another fastener 106 flush against the container interior surface 92 at a location directly above the lower contact element 104 so that there is a vertical gap 107 between the vertical portion 108 of the upper contact element and the lower contact element. The upper contact element is further formed by a horizontal portion 110 which is integral with the vertical portion 108 and which extends inward (rightward) from the interior surface 92 of the container body. Furthermore, the upper contact element includes a vertical portion 112 which extends integrally downward from the horizontal portion 110 and which is aligned with and spaced inward from the lower contact element 104. In this manner there is no electrically conductive residue between the upper and lower contact elements to give false indications of fluid level because the level of the Processor fluid never reaches the nonconductive gap 107 between the upper and lower contact elements.

What is claimed is:

1. A fluid replenishment and recirculation system comprising:

a. means for containing the fluid, the containing means including a first container section and a second container section which are separated by a submerged wall which has a top edge which is located below a top surface of the fluid;

b. means for transferring the fluid from the first container section to the second container section;

c. means for inputting the transferred fluid into the second container section in a manner that the fluid in the second container section is moved in a circulating flow pattern so that an upper portion of the circulating fluid is distributed across the top edge of the submerged wall and into the first container; and d. means for adding fluid into the containing means by introducing the fluid into the first container section in a manner that the added fluid is mixed with the fluid present in the first container section before being transferred into the second container section by the transferring means.

2. The system as set forth in claim 1 wherein the transferring means operates to introduce the fluid into a lower portion of the second container section in a manner that the fluid is directed upward in the second container section of the container means and then across to the submerged wall where the upper portion of the fluid above the top edge enters the first container section, and a lower portion of the fluid flow below the top edge is directed downward in the second container section by the submerged wall to establish the circulating flow pattern.

3. The system as set forth in claim 2 wherein the second container section includes means for receiving the fluid from the transferring means and for directing the fluid in a substantially horizontal direction toward a wall of the second container section to be directed upward toward the surface of the fluid in the circulating flow pattern.

4. The system as set forth in claim 1 additionally comprising means for draining the fluid from the container means, the draining means being connected to an overflow wall of the container means so that when the level of the fluid exceeds a top edge of the overflow wall due to the introduction of the added fluid into the first container section, a top portion of the fluid flows over the top edge and into the draining means.

5. The system as set forth in claim 1 wherein the transferring means includes means for sensing when a level of fluid in the containing means falls below a selected level, the sensing means including first and second conductive elements which are connected to the containing means and which extend at least to the selected level so that when the fluid is at the selected level, an electrically conductive circuit can be completed between the first and second elements via the fluid, and when the level of the fluid is below the selected level, the electrically conductive circuit between the first and second elements is interrupted, the sensing means being further characterized in that at least one of the first and second elements is spaced apart from an interior surface of the containing means so that an electrically conductive circuit between the first and second elements is not formed by a residue of the fluid remaining on the interior surface when the fluid falls below the selected level.

6. The system as set forth in claim 1 wherein the containing means further includes a third container section which is separated from the second container section by a first dividing wall which has a top edge which is higher than the top edge of the submerged wall in a manner that when a level of fluid in the second container section exceeds the top edge of the first dividing wall, a portion of the fluid from the second container section flows into the third container section.

7. The system as set forth in claim 6 wherein the containing means further includes a drain section which is separated from the third container section by a second dividing wall so that when the level of fluid in the second container section exceeds a top edge of the second dividing wall due to the introduction of the added fluid in the first container section and corresponding increases in the levels of the fluid in the second and third container sections, a portion of the fluid from the third container section flows over the top edge of the second dividing wall and into the drain section for removal from the system.

8. A fluid replenishment and recirculation system comprising:

a. means for containing the fluid, the containing means including a first container section and a second container section which are separated by a submerged wall which has a top edge which is located below a top surface of the fluid;

b. means for transferring the fluid from the first container section to the second container section;

c. means for inputting the transferred fluid into the second container section in a manner that the fluid in the second container section is moved in a circulating flow pattern so that an upper portion of the circulating fluid is distributed across the top edge of the submerged wall and into the first container section; and d. means for draining the fluid from the container means, the draining means being connected to an overflow wall of the container means so that when the level of the fluid exceeds a top edge of the overflow wall due to the introduction of the added fluid into the first container section, a top portion of the fluid flows over the top edge and into the draining means.

9. A fluid replenishment and recirculation system comprising:

a. means for containing the fluid, the containing means including a first container section and a second container section which are separated by a submerged wall which has a top edge which is located below a top surface of the fluid;

b. means for transferring the fluid from the first container section to the second container section; the transferring means including means for sensing when a level of fluid in the containing means falls below a selected level, the sensing means including first and second conductive elements which are connected to the containing means and which extend at least to the selected level so that when the fluid is at the selected level, an electrically conductive circuit can be completed between the first and second elements via the fluid, and when the level of the fluid is below the selected level, the electrically conductive circuit between the first and second elements is interrupted, the sensing means being further characterized in that at least one of the first and second elements is spaced apart from an interior surface of the containing means so that an electrically conductive circuit between the first and second elements is not formed by a residue of the fluid remaining on the interior surface when the fluid falls below the selected level; and c. means for inputting the transferred fluid into the second container section in a manner that the fluid in the second container section is moved in a circulating flow pattern so that an upper portion of the circulating fluid is distributed across the top edge of the submerged wall and into the first container section.

10. A fluid replenishment and recirculation system comprising:

a. means for containing the fluid, the containing means including a first container section and a second container section which are separated by a submerged wall which has a top edge which is located below a top surface of the fluid; and further including a third container section which is separated from the second container section by a first dividing wall which has a top edge which is higher than the top edge of the submerged wall in a manner that when a level of fluid in the second container section exceeds the top edge of the first dividing wall, a portion of the fluid from the second container section flows into the third container section;

b. means for transferring the fluid from the first container section to the second container section; and c. means for inputting the transferred fluid into the second container section in a manner that the fluid in the second container section is moved in a circulating flow pattern so that an upper portion of the circulating fluid is distributed across the top edge of the submerged wall and into the first container section.

* * * * *